US006889893B2

(12) United States Patent
Kent

(10) Patent No.: US 6,889,893 B2
(45) Date of Patent: May 10, 2005

(54) STACKABLE CONTAINER WITH STACK-TABS

(75) Inventor: David Kent, La Mirada, CA (US)

(73) Assignee: Weyerhaeuser Company, Federal Way, WA (US)

( * ) Notice: Subject to any disclaimer, the term of this patent is extended or adjusted under 35 U.S.C. 154(b) by 93 days.

(21) Appl. No.: 10/796,944

(22) Filed: Mar. 9, 2004

(65) Prior Publication Data

US 2004/0173669 A1 Sep. 9, 2004

Related U.S. Application Data

(63) Continuation of application No. 10/068,679, filed on Feb. 5, 2002, now abandoned.

(51) Int. Cl.[7] ..... B55D 21/032

(52) U.S. Cl. ..... 229/171; 229/120; 229/915; 229/918; 229/919

(58) Field of Search ..... 229/120, 171, 229/178, 915, 918; 206/509, 511, 512

(56) References Cited

U.S. PATENT DOCUMENTS

| | | | | |
|---|---|---|---|---|
| 2,721,689 | A | | 10/1955 | Nye |
| 3,102,674 | A | | 9/1963 | Hamilton |
| 3,355,054 | A | | 11/1967 | Wilson |
| 3,946,934 | A | | 3/1976 | Chaffers |
| 3,973,723 | A | | 8/1976 | Owens |
| 4,567,996 | A | | 2/1986 | Muise |
| 4,770,339 | A | | 9/1988 | Weimer |
| 5,002,224 | A | | 3/1991 | Muise |
| 5,429,296 | A | | 7/1995 | Southwell et al. |
| 5,458,283 | A | | 10/1995 | Southwell et al. |
| 5,649,663 | A | | 7/1997 | Pestow |
| 5,662,508 | A | | 9/1997 | Smith |
| 5,860,590 | A | | 1/1999 | Blomfield et al. |
| 6,098,873 | A | * | 8/2000 | Sheffer ..... 229/178 |
| 6,131,805 | A | | 10/2000 | Gasior |
| 6,270,009 | B1 | | 8/2001 | Heeren |

FOREIGN PATENT DOCUMENTS

| | | |
|---|---|---|
| EP | 337840 | 10/1989 |
| FR | 2682936 | 4/1993 |

* cited by examiner

*Primary Examiner*—Gary E. Elkins

(57) ABSTRACT

A tray-type container 10 includes a bottom wall 20, longitudinally-extending outer side walls 22, and laterally-extending end walls 24, the outer side walls 22 and the end walls 24 extending upwardly from the bottom wall 20 to form an inner cavity 26. As erected, the outer side walls 22 include a plurality of spaced-apart stacking tabs 28A–28D, and the bottom wall forms a plurality of spaced-apart apertures 60, 70, 80, 82, 86, and 88 for receiving the stacking tabs 28A–28D of like or similar containers. A plurality of tray-type containers 10 may be unitized in several stacked configurations utilizing the stacking tabs 28 and apertures 60, 70, 80, 82, 86, and 88. Typically, the plurality of unitized containers 10 are placed upon a shipping pallet or slip sheet, or placed within a shipping container to facilitate shipping by large carriers.

7 Claims, 10 Drawing Sheets

STACKABLE CONTAINER WITH STACK-TABS

RELATED APPLICATIONS

This application is a continuation of prior application Ser. No. 10/068,679, filed Feb. 5, 2002 now abandoned, priority from the filing date of which is hereby claimed under 35 U.S.C. §120. Prior application Ser. No. 10/068,679 is hereby incorporated by reference.

FIELD OF THE INVENTION

The present invention relates to shipping containers, and more particularly, to shipping containers having stacking tabs formed from a single blank.

BACKGROUND OF THE INVENTION

In the shipping container art, there are many container designs that are manufactured for various end uses. One popular end use for a container is holding fresh fruits and produce during the transportation process (i.e., packing and shipping), and for displaying at the retail level. Usually when packing produce, such as tomatoes, peaches, mangos and the like, there is a typical size requirement in that the container volume is sized to hold a certain amount of product. There is also a strength requirement given the weight of the product packed and the shipping and handling requirements. Such containers are generally rectangular and have a variable height dimension ranging from three to twelve inches. Further, these containers are typically transported, stored, and displayed in a stacked configuration.

A well known single piece container design for holding produce is a single-piece tray type where a single piece of corrugated cardboard is cut and scored to form a flat blank. The blank has a bottom, two side walls hinged to the bottom and at least two end walls hinged to the bottom. To form the container, the walls of the blank are folded upwardly to be normal to the bottom and then connected to form the containment volume within the four walls. Variations are well known where top closure flaps are hinged to the top edges of the side walls, and for stacking strength, a second end wall can be hinged to the top edge of first end wall to then form a double layer of material thereby enhancing the stacking strength.

As was mentioned above, the tray-type containers are typically stacked on top of one another during shipping, storing, and displaying at the retail level. To that end, suitable stacking strength is one requirement of these types of containers so that the containers can be stacked as much as twenty containers high. One drawback with stacking containers into a unitized load is that the stacking strength is reduced if the containers are misaligned. To address this problem, stacking tabs and associated apertures have been added to the standard tray-type container to aid in the alignment of the stacked containers when stacked into a unitized load, while also maintaining the alignment of the containers during the transportation process. However, the current tray-type containers with stacking tabs only allow for stacking in a column style configuration (i.e. the longitudinal axis of each container are parallel with one another). Therefore, with the advent of stacking tabs, it has been the desire of the container industry to develop a tray type-container with stacking tabs that is stackable in the column configuration, as well as other stacking configurations, such as an interlocking configuration.

SUMMARY OF THE INVENTION

In accordance with aspects of the present invention, a single piece blank for forming a tray-type container having an inner cavity and at least one stacking tab extending upwardly from the top of the container is provided. The blank includes a bottom wall panel, and an end wall panel hingedly connected to the bottom wall panel by a first fold line. The blank also includes an outer side wall panel having an outer edge and hingedly connected to the bottom wall panel by a second fold line. An inner side wall panel is hingedly connected to the outer wall panel remote from the bottom wall panel by at least one bridge section such that when erected, the inner side wall panel is folded about the bridge section, thereby forming a stacking tab from the bridge section which extends outwardly away from the bottom panel. The blank further includes at least one first aperture positioned along the second fold line between the bottom panel and the outer side wall panel and adapted to receive a stacking tab of another container when stacked in a first configuration, and at least one second aperture spaced-apart from the first aperture and positioned along the second fold line between the bottom panel and the outer side wall panel. The second aperture is adapted to receive a stacking tab of another container when stacked in a second configuration, the second configuration being different than the first configuration.

In accordance with another aspect of the present invention, a container includes a bottom wall, and side walls that extend upwardly from the bottom wall. At least one stacking tab extends upwardly from each side wall. The container also includes end walls that extend upwardly from the bottom wall to form, along with the side walls, an inner cavity. At least one first aperture is formed at the intersection of each of the side walls and the bottom wall. The first apertures are adapted to receive a stacking tab of another container when stacked in a column configuration. The container further includes at least one second aperture formed at the intersection of each of the side walls and the bottom wall and spaced apart from the first apertures. The second apertures are adapted to receive a stacking tab of another container when stacked in the interlocking configuration. At least one third aperture is formed at the intersection of each of the end walls and the bottom wall. The third apertures are adapted to receive a stacking tab of another container when stacked in the interlocking configuration. The container further includes a plurality of spaced-apart fourth apertures formed in the bottom wall remote from the intersection of the side walls and the bottom wall. The fourth apertures are adapted to receive a stacking tab of another container when stacked in the interlocking configuration.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention will now be described with reference to the accompanying drawings where like numerals correspond to like elements. The present invention is directed to a tray-type container that utilizes stacking tabs on opposite side walls to create a modular stackable container. The container includes an arrangement of apertures, which are adapted to receive the stacking tabs of another similar container to provide for several different stacking configurations.

Figure 1:
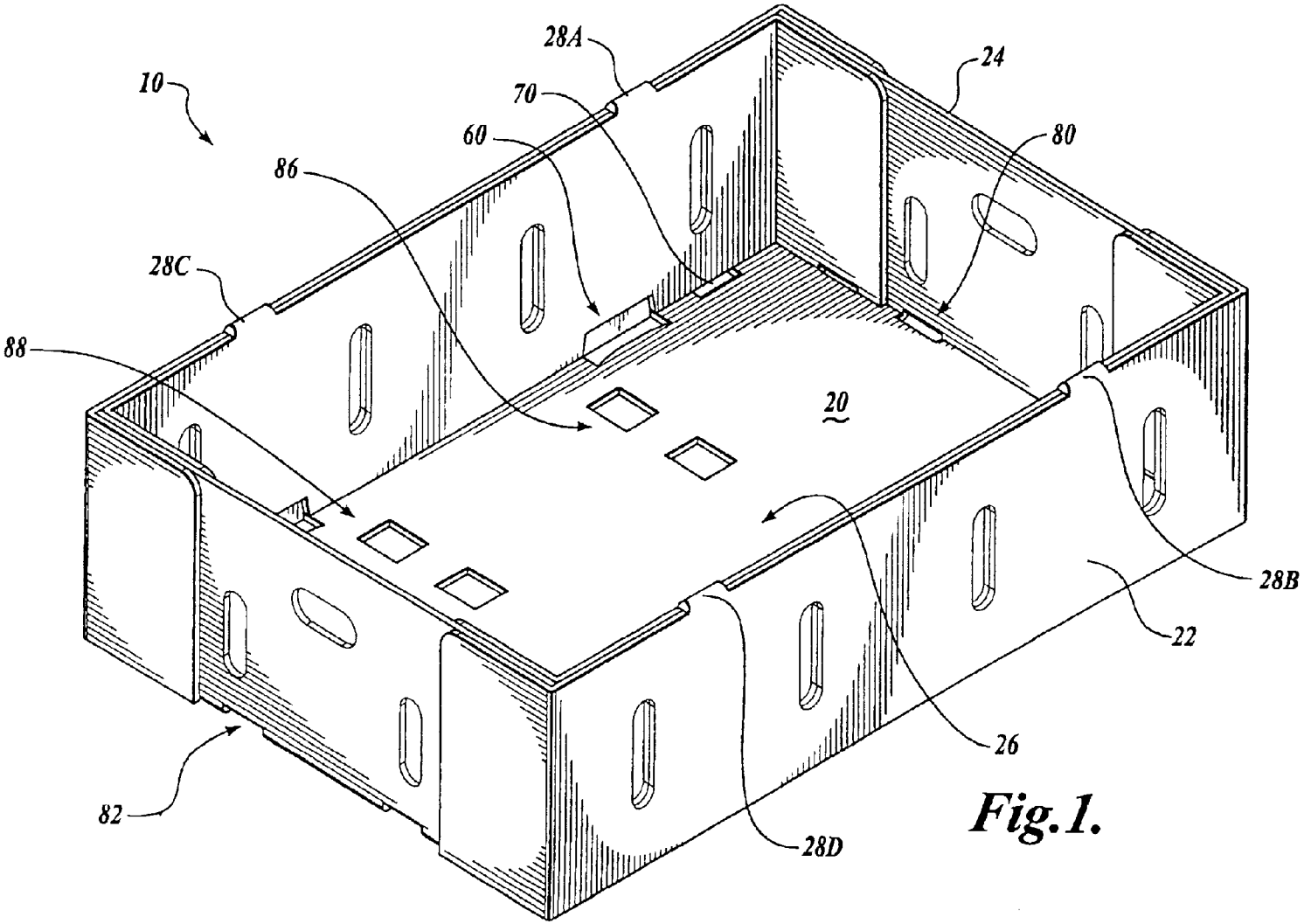
FIG. 1 is a perspective view of a tray-type container formed in accordance with the present invention.

One suitable embodiment of a tray-type container, generally designated 10, constructed in accordance with the present invention is illustrated in FIG. 1. The tray-type container 10 includes a bottom wall 20, longitudinally-extending outer side walls 22, and laterally-extending end walls 24, the outer side walls 22 and the end walls 24 extending upwardly from the bottom wall 20 to form an inner cavity 26. As erected, the outer side walls 22 include a plurality of spaced-apart stacking tabs 28A–28D, and the bottom wall forms a plurality of spaced-apart apertures 60, 70, 80, 82, 86, and 88 for receiving the stacking tabs 28A–28D of like or similar containers. A plurality of tray-type containers 10 may be unitized in several stacked configurations utilizing the stacking tabs 28 and apertures 60, 70, 80, 82, 86, and 88. Typically, the plurality of unitized containers 10 are placed upon a shipping pallet or slip sheet, or placed within a shipping container to facilitate shipping by large carriers.

Figure 2:
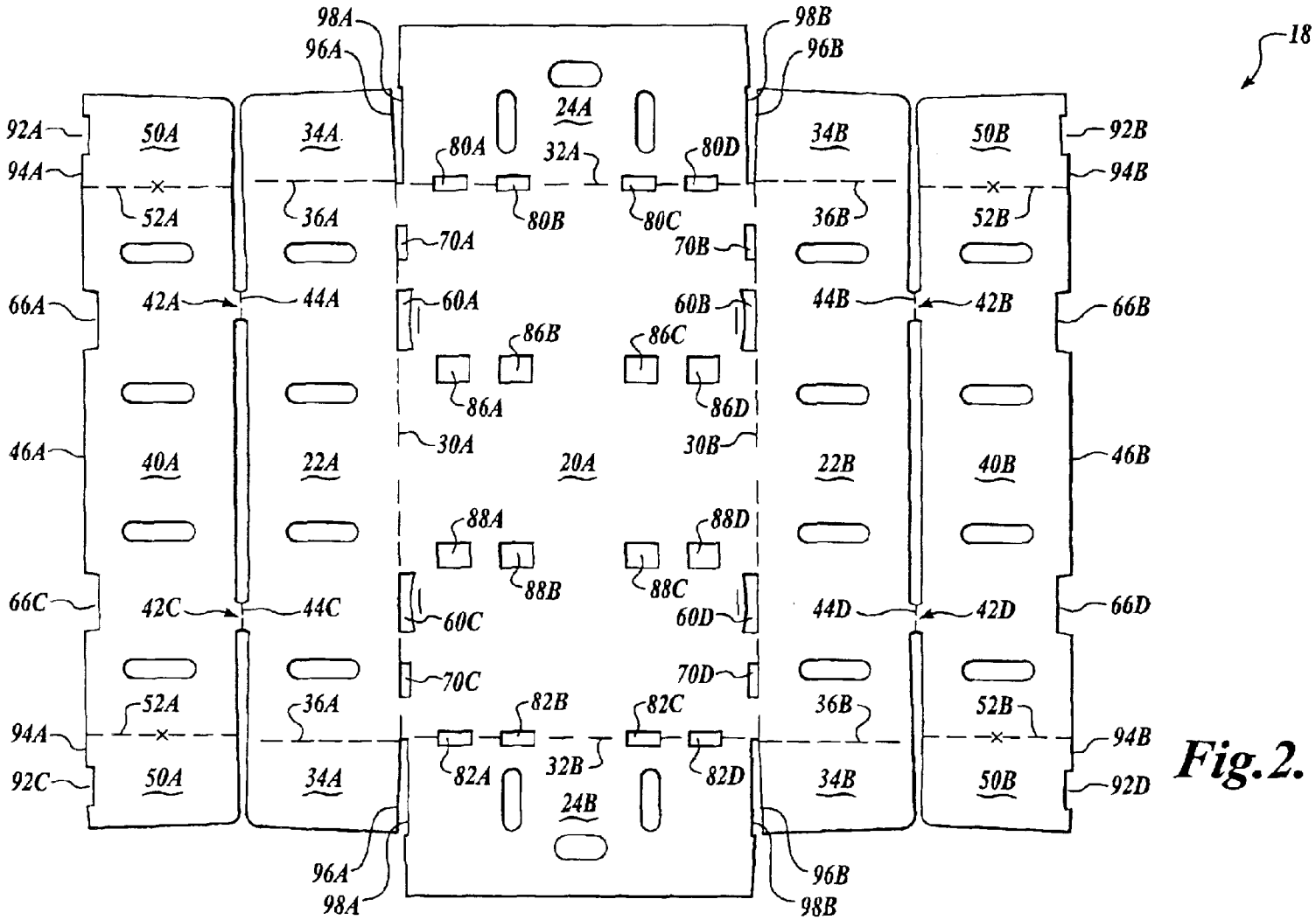
FIG. 2 is a plan view of a blank from which the tray-type container of FIG. 1 is formed.

The tray-type container 10 shown in FIG. 1 is made from any suitable material used in shipping, such as cardboard, pasteboard, fiberboard, corrugated cardboard, plastic, or a combination thereof. As best shown in FIG. 2, a blank 18 is stamped out of any of these suitable materials and assembled in a manner which can be seen in FIG. 1.

With continued reference to FIG. 2, the blank 18 includes a bottom wall panel 20A of generally rectangular shape having four edges. Unless otherwise apparent, the term "edges" refers generally to a zone or line of weakness along which a part can be folded, such as a score line, or a cut line. Opposite outer side wall panels 22A and 22B are hingedly connected to opposite side edges of the bottom panel 20A along interrupted fold lines 30A and 30B, respectively. The blank 18 further includes opposite end wall panels 24A and 24B, which are hingedly connected to the remaining two opposite edges of the bottom panel 20A along interrupted fold lines 32A and 32B, respectively. The outer side wall panels 22A and 22B include end flaps 34A and 34B, which are hingedly connected to opposite ends of outer side wall panels 22A and 22B along fold lines 36A and 36B, respectively. The fold lines 36A and 36B are substantially perpendicular to fold lines 30A and 30B. When erected, as will be described in more detail below, the bottom wall panel 20A, the outer wall panels 22A and 22B, and the end wall panels 24A and 24B form the bottom wall 20, the outer side walls 22, and the end walls 24, respectively, as shown in FIG. 1.

Referring now to FIG. 2, the blank 18 further includes opposite inner side wall panels 40A and 40B, which are hingedly connected to outer side wall panels 22A and 22B, respectively, via bridge sections 42A–42D. The bridge sections 42A–42D include fold lines 44A–44D, preferably bisecting the bridge sections 42A–42D. The inner side walls 40A and 40B are preferably constructed with a suitable height dimension such that outer edge portions 46A and 46B abut against the corresponding portions of bottom panel 20A, thereby creating a standard double-ply side panel. In achieving the folded position, the inner side wall panels 40A and 40B rotate inwardly 180 degrees about fold lines 44A–44D, thereby forming upstanding projections or stacking tabs 28A–28D from the bridge sections 42A–42D, respectively (The stacking tabs 28A–28D are best shown in FIG. 1). The stacking tabs 28A–28D formed from the bridge sections 42A–42D are suitably dimension to be inserted into complimentary apertures of a like or similar container as container 10, as will be described in more detail below. In one embodiment, the stacking tabs are approximately 1.25 inches long and 0.25 inches tall and are spaced approximately 11.8125 inches apart. The inner side wall panels 40A and 40B include end flaps 50A and SOB, which are hingedly connected to opposite ends of inner side wall panels 40A and 40B along fold lines 52A and 52B, respectively. The fold lines 52A and 52B are substantially perpendicular to fold lines 30.

Figure 4:
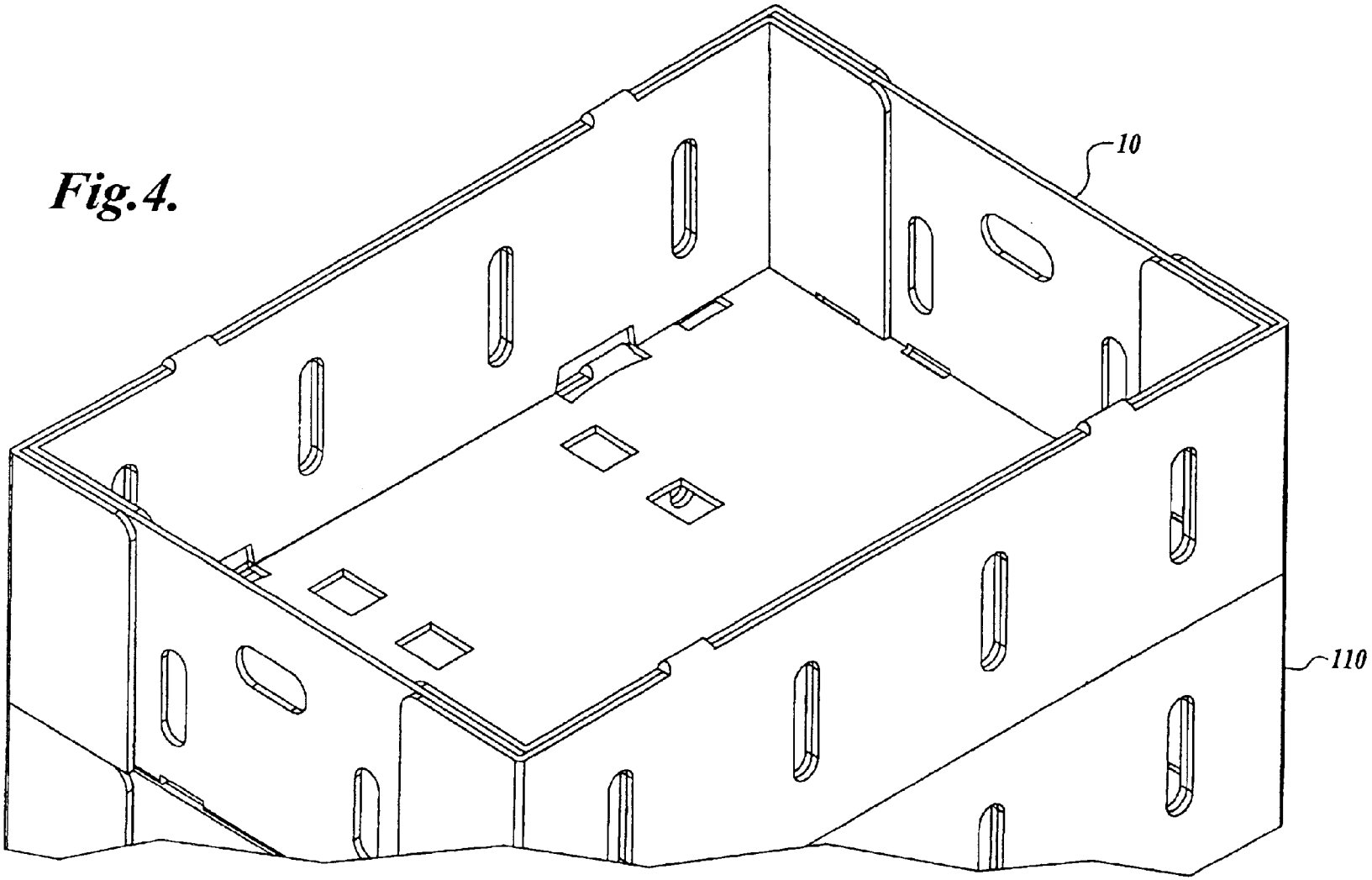
FIG. 4 is a perspective view of a plurality of tray-type containers of FIG. 1 in a column stacking configuration.

In accordance with one aspect of the present invention, stacking tabs 28A–28D are provided with the tray-type container 10 and may be suitable formed as described above. The stacking tabs 28A–28D are utilized to extend into a first set of apertures located in a similarly constructed tray-type container 10 when properly aligned longitudinally in a stacked configuration known as column stacking, as best shown in FIG. 4. Looking now to the intersection of the bottom panel 20A and the outer side wall panels 22A and 22B of FIG. 2, the fold lines 30A and 30B are interrupted by cut-out portions 60A–60D. In the embodiment shown, pairs of spaced-apart cut-out portions 60A, 60C and 60B, 60D are positioned to interrupt fold lines 30A and 30B, respectively. The fold lines 30A and 30B form a part of the bottom edge of the erected container in its erected condition, and thus, the cutout portions 60A–60D form the apertures 60 along the bottom edges of the outer side walls 22, as best shown in FIG. 1. Each cut-out portion 60A–60D is suitably positioned and dimensioned to accept upwardly extending stacking tabs 28A–28D from another similar container positioned beneath the container 10 as best shown in FIG. 4. Additionally, each cut-out portion 60A–60D is suitably positioned and dimensioned to accept an upwardly extending stacking tab from a container described in co-pending application Ser. No. 09/974,447, which is hereby incorporated be reference. Returning to FIG. 2, provided along the outer edges 46A and 46B of inner side wall panels 40A and 40B, respectively, are pairs of spaced-apart generally rectangular cut-out portions 66A, 66C and 66B, 66D, which are in substantial alignment with respective cut-out portions 60A, 60C and 60B, 60D. Likewise, the cut-outs portions 66A–66D are suitably dimensioned to accept upwardly extending stacking tabs 28A–28D when like or similar containers are stacked one atop another.

Figure 5:
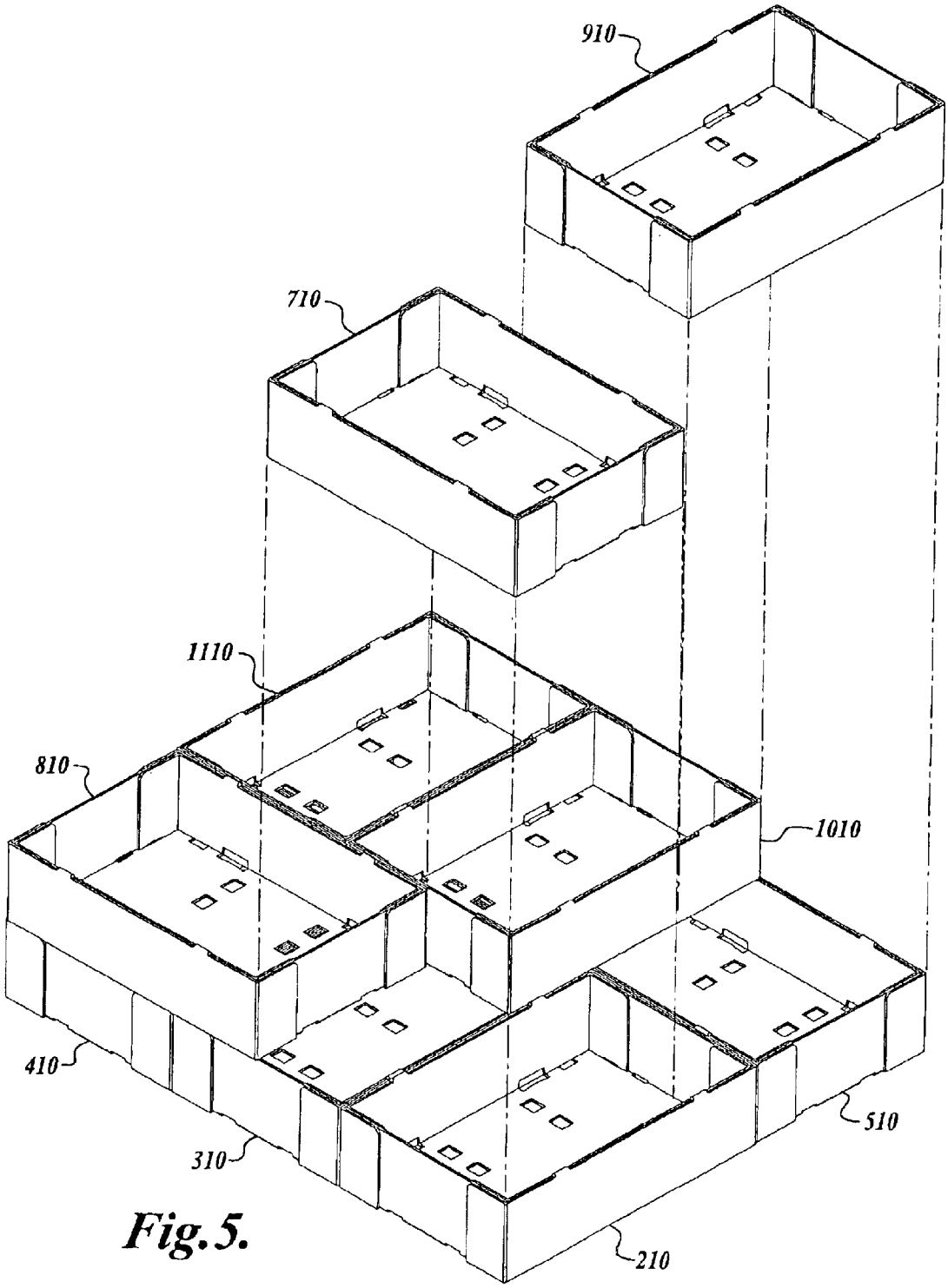
FIG. 5 is a perspective view of a plurality of tray-type containers of FIG. 1 in a cross-stacking or interlocking configuration.

In accordance with another aspect of the present invention, the container 10 is suitable for cross stacking as shown best in FIG. 5. To permit stacking in this configuration, the container 10 includes additional apertures for receiving the stacking tabs of other like containers, which will now be described in detail. Looking back to the intersection of the bottom panel 20A and the outer side wall panels 22A and 22B of FIG. 2, the fold lines 30A and 30B are further interrupted by pairs of spaced-apart cut-out portions 70A, 70C and 70B, 70D, respectively. The cut-out portions 70A–70D are positioned on the end wall panel side of and spaced-apart from the respective cut-out portions 60A–60D such that the outer edges of the cut-out portions 70A, 70C and 70B, 70D lie on the axes of the fold lines 30A and 30B, respectively. Thus, the cut-out portions 70A–70D form the apertures 70 along the bottom edges of the outer side walls 22, as best shown in FIG. 1. The cut-out portions 70A–70D are suitably positioned and dimensioned to receive any one of stacking tabs 28A–28D of another erected container 10, as will be described in more detail below.

Similar to fold lines 30A and 30B, the fold lines 32A and 32B are interrupted by sets of cut-out portions 80A–80D and 82A–82D. As shown in FIG. 2, the cut-out portions 80A–80D and 82A–82D are bisected by the fold lines 32A and 32B, respectively. The fold lines 32A and 32B form a part of the bottom edge of the erected container in its erected condition, and thus, the cutout portions 80A–80D and 82A–82D form the apertures 80 and 82 along the bottom edges of the end walls 24, as best shown in FIG. 1. Each cut-out portion of the sets of cut-out portions 80A–80D and 82A–82D is suitably positioned and dimensioned to accept an upwardly extending stacking tab from another similar container positioned beneath the container 10. Provided along the outer edges 94A and 94B of inner side wall panel end flaps 50A and 50B, respectively, are generally rectangular cut-out portions 92A–92D. When the container is in the erected position, cut-out portions 92A–92D are in substantial alignment with respective cut-out portions 80A, 80D, 82A, and 82D. Likewise, the cut-out portions 92A–92D are suitably dimensioned to accept upwardly extending stacking tabs 28A–28D when like or similar containers are stacked one atop another.

The container 10 further includes a plurality of spaced-apart cut-out portions formed in the bottom panel 20A. In the embodiment shown, cut-out portions 86A–86D and 88A–88D are formed in the bottom panel 20A in substantial lateral alignment, while cut-out portions 86A and 88A, 86B and 88B, 86C and 88C, and 86D and 88D, are in longitudinal alignment with cut-out portions 80A and 82A, 80B and 82B, 80C and 82C, and 80D and 82D, respectively. The cut-out portions 86A–86D and 88A–88D are generally rectangular in shape and are suitably dimensioned to receive two adjacent stacking tabs of side by side containers.

To enhance the ability for the container 10 to be stacked one upon another, the side walls are constructed to tilt or lean inwardly into the cavity 26 of the container 10 when the container is assembled. Thus, the stacking tabs 28A–28D on the tilted side walls are in direct alignment with the apertures 60A–60D disposed in the bottom wall panel 20A. To achieve the tilting side walls, end panel facing edges 96A and 96B of the end flaps 34A and 34B, respectively, taper away from the end panels 24A and 24B while the outer edges 94A and 94B of the end flaps 50A and 50B, respectively, taper toward the end panels 24A and 24B. To accommodate the side walls slanting inwardly when erected, opposite edges of the end wall panels 24A and 24B are formed with notches 98A and 98B. Thus, when erected, the outer side wall panel 22A and 22B engage the notches 98A and 98B of the end wall panel 24A and 24B at fold lines 36A and 36B, while the edges 96A and 96B and 94A and 94B of the end flaps 34A and 34B and 50A and 50B, respectively, align with the fold lines 32A and 32B. Accordingly, the depth of the notches 98A and 98B determines the tilting angle of the side walls.

Figure 3A:
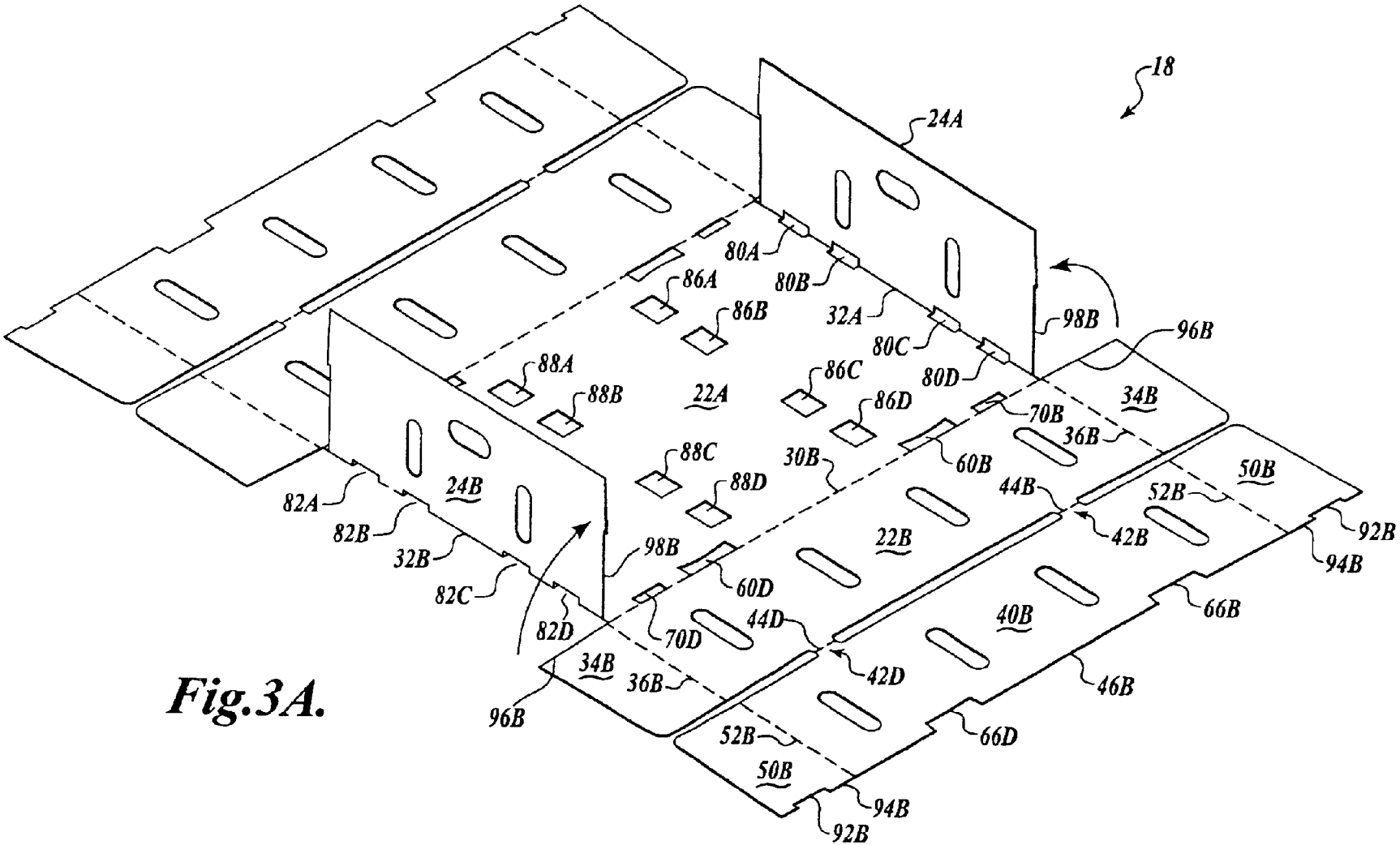
FIG. 3A–3D are perspective views of one erection sequence of the blank shown in FIG. 2.
Figure 3B:
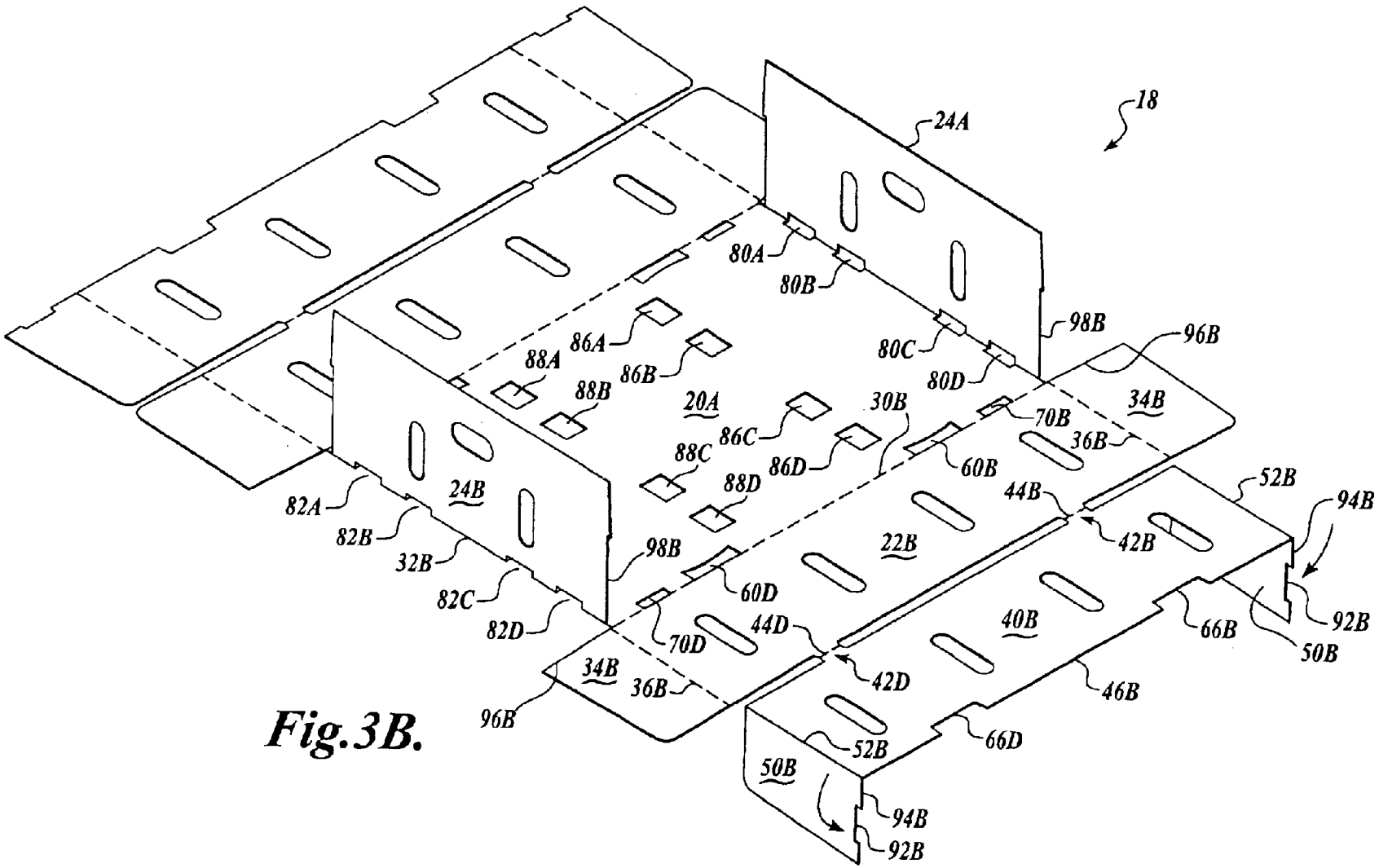

Referring now to FIGS. 3A–3D, one method of constructing the tray-type container 10 from the blank 18 will be described. In the ensuing description, erecting one side of the containers will be described. However, it will be appreciated that the other side of the container is formed in substantially similar steps. The first step begins with the end wall panels 24A and 24B being each folded upright approximately 90° with respect to the bottom wall panel 20A, as best shown in FIG. 3A. In this position, cutout portions 8OA–80D and 82A–82D form apertures along the edges of the end walls of the container to accommodate stacking tabs of another similar container. Next, the end flaps 50B of the inner side wall panel 40B are folded outwardly 90° about fold lines 52B, as best shown in FIG. 3B.

Figure 3C:
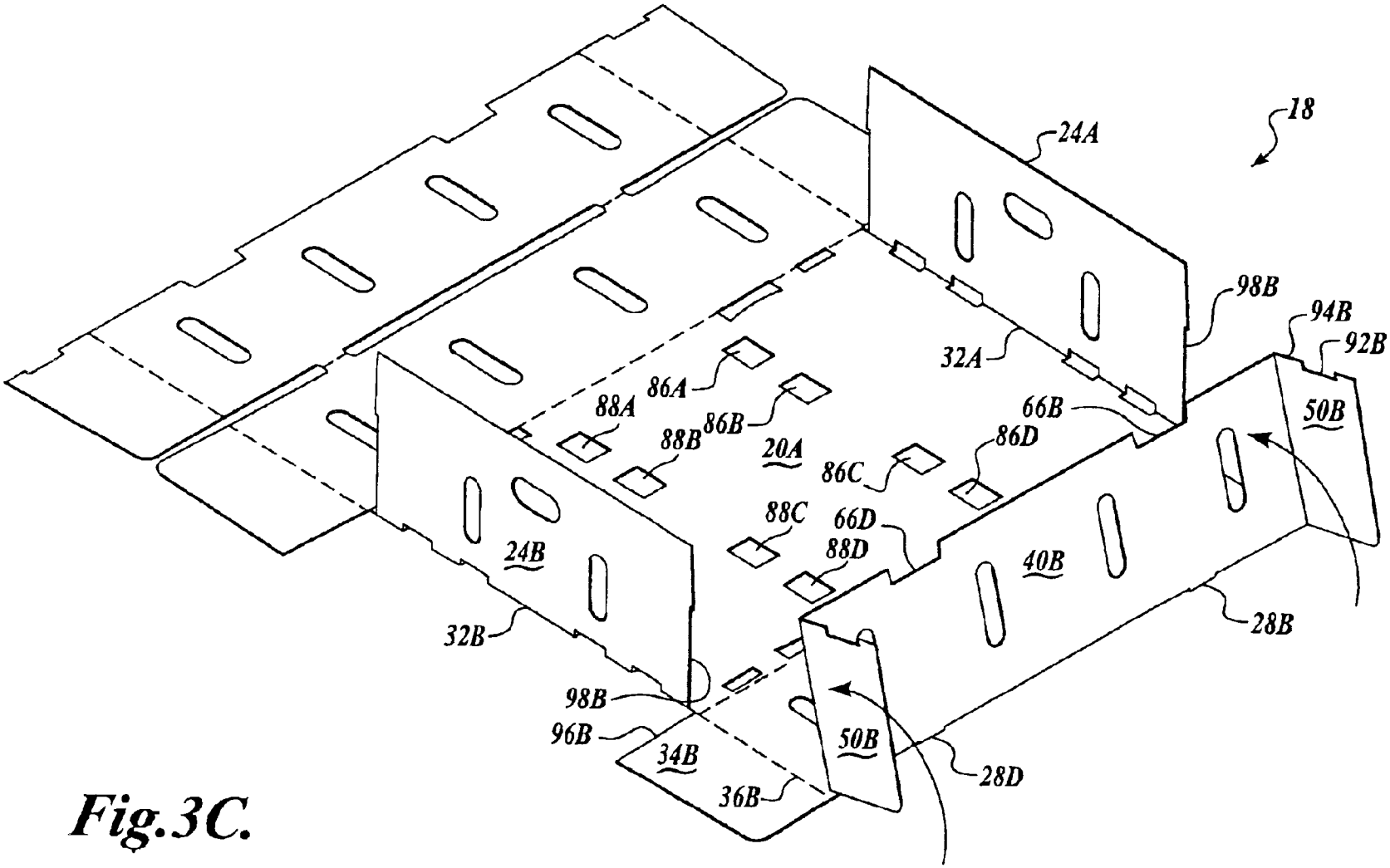

The inner side wall panel 40B is then folded inwardly 180° along fold lines 44B and 44D so that inner side wall panel 40B is juxtaposed against outer side wall panel 22B, causing the now folded end flaps 50 to be in an upright position. At the same time the inner side wall panels 40 are folded inwardly 180° along fold lines 44B and 44D so that inner side wall panel 40B is juxtaposed against outer side wall panel 22B, the stacking tabs 28B and 28D are formed from the bride sections 42B and 42D, as best shown in FIG. 3C.

Figure 3D:
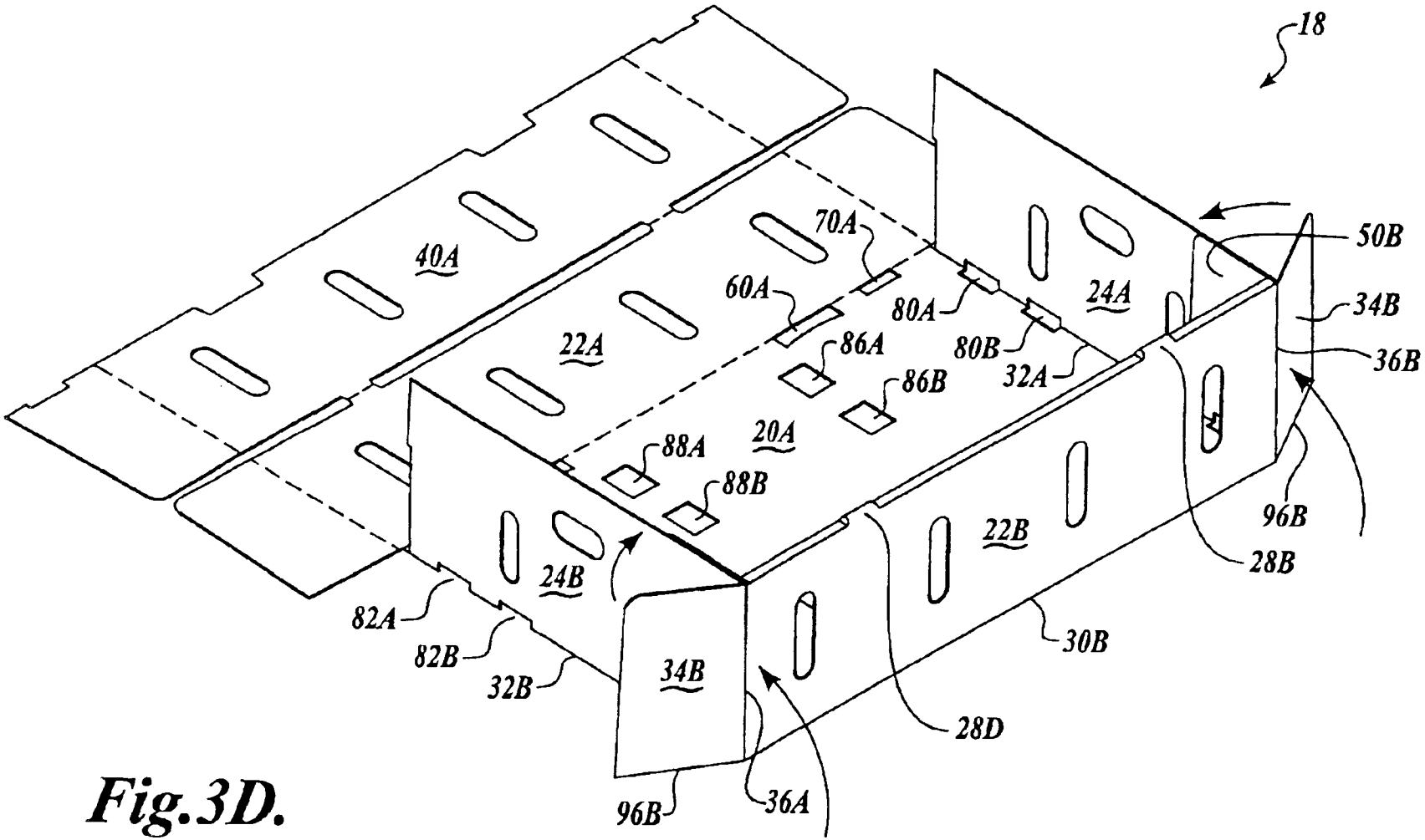

Next, the double-ply panel formed by the inner side wall and the outer side wall is folded upright 90° about fold line 30B so that the fold lines 36B abut against the notches 98B (FIG. 3C) of the end wall panels 24A and 24B, as shown in FIG. 3D. The flaps 34B are then rotated inwardly 90° about fold lines 36B so that they are juxtaposed against the outer surface of end wall panels 24A and 24B, and secured to the outer surface of end wall panels 24 via any conventional manner, such as being stitched or glued, to form corners. The resulting erected container forms the bottom wall 20, to outer side wall 22B, and the end walls 24A and 24B. The end flaps 60 may then be secured to the inside surface of end walls 24 via any conventional manner, such as being stitched or glued. As was described above, the edges of end flaps 34B and 50B are formed with a slight taper and the edges of the end wall panel 24A and 24B are formed with notches 98B, such that when secured together, the outer side wall 22B slant slightly inward toward the middle of the container 10.

Figure 6:
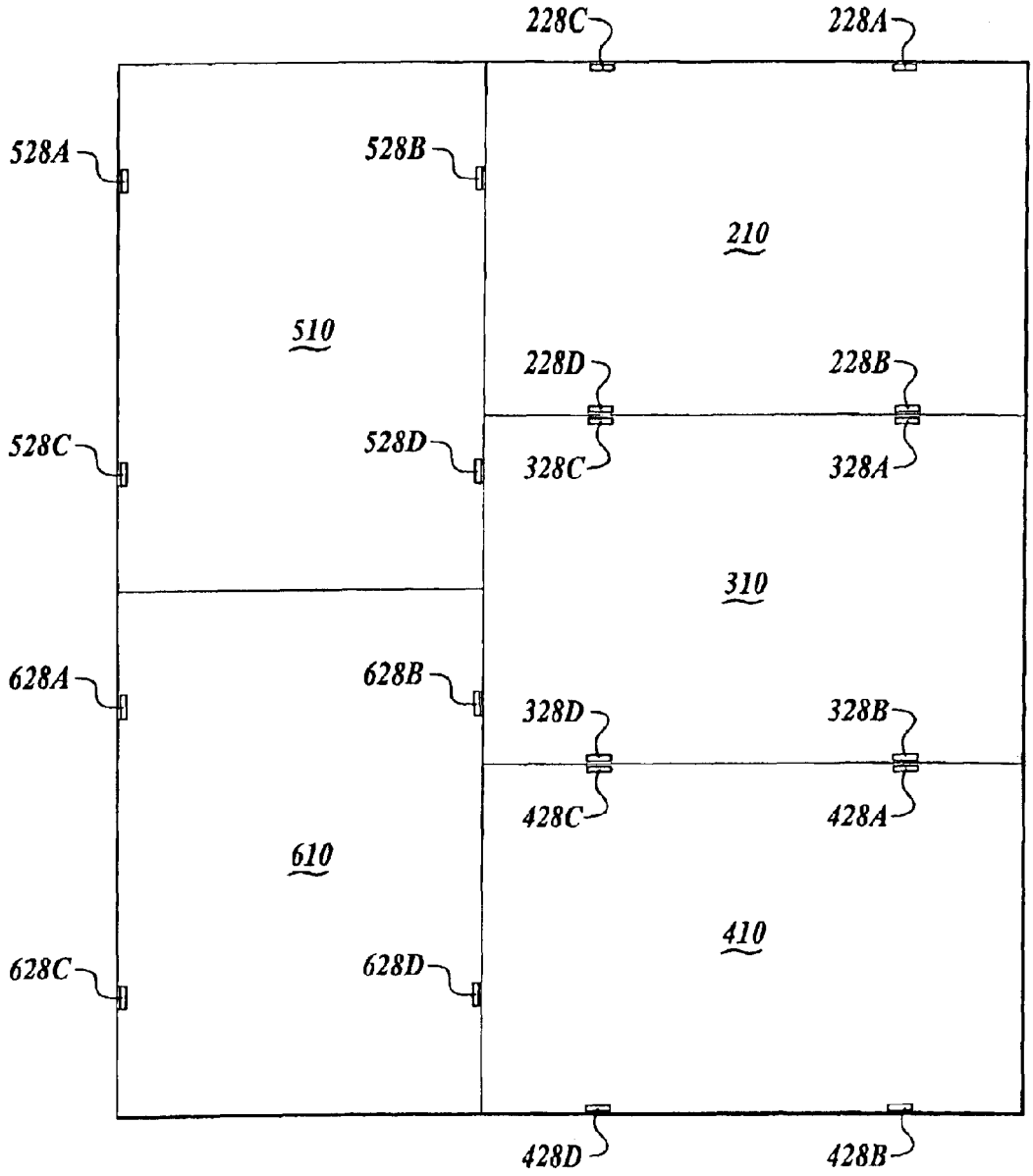
FIG. 6 is a plan view of a schematic representation of the first layer of the cross stacking configuration of FIG. 5.

Once the container is erected from the blank 18 as described above, multiple assembled containers may be stacked in a longitudinal alignment known as column stacking, as shown best in FIG. 4, or may be arranged in a cross-stacking configuration known as an interlocking configuration in the packaging art. One such interlocking or cross-stacked configuration, which may be employed with the containers, is shown in FIG. 5. The cross-stacking configuration is composed in layers of five containers, each layer alternating in arrangement. The first layer of the cross-stacked configuration is shown in FIG. 6, which is a plan view of a schematic representation of the first layer of the cross stacking configuration shown in FIG. 5. The first layer includes three containers 210, 310, and 410 placed side-by-side and abutting against one another. To complete the first layer, two containers 510 and 610 are placed end to end against the end walls of the containers 210, 310, and 410. In this position, stacking tabs 228B and 228D of container 210 are positioned adjacent to stacking tabs 328A and 328C of container 310, respectively. Likewise, stacking tabs 328B and 328D of container 310 are positioned adjacent to stacking tabs 428A and 428C of container 410, respectively.

Figure 7:
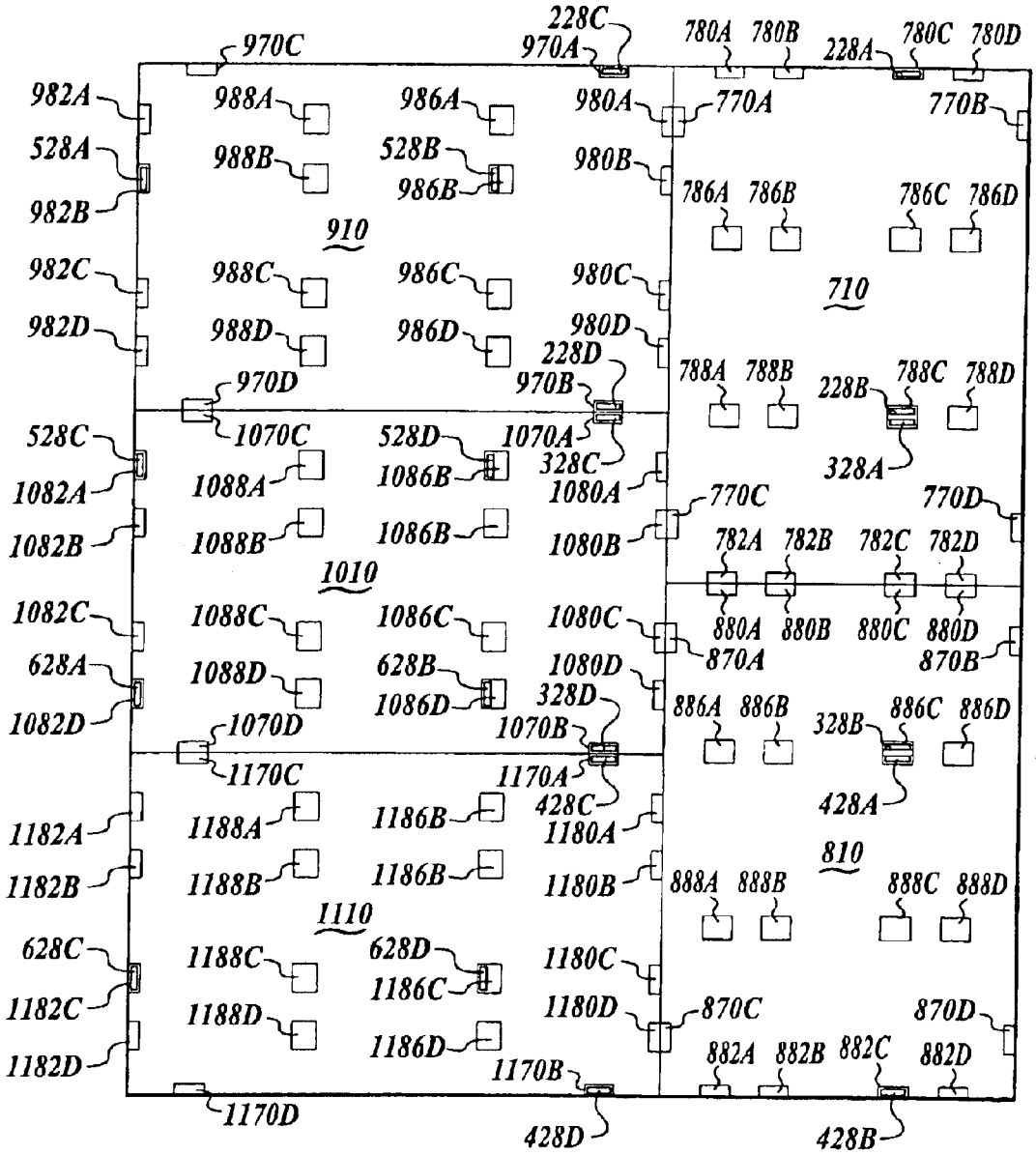
FIG. 7 is a plan view of a schematic representation of the second layer of the cross stacking configuration of FIG. 5 placed on the first layer of FIG. 6, wherein the stacking tabs of each container of the first layer protrude up through the associated apertures of the containers of the second layer.

To begin forming the second layer shown best in FIGS. 5 and 7, a first container 710 is placed on the first layer of containers such that the outward facing side wall and end wall of the container 710 are coplanar with the outward facing end wall and side wall of container 210, respectively. When the container 710 is lowered into the position shown in FIG. 7, the stacking tab 228A of container 210 extends upwardly into cut-out portion 780C of container 710, while adjacent stacking tabs 228B and 328A of containers 210 and 310, respectively, extend upwardly into cut-out portion 788C of container 710. Since the cut-out portions and stacking tabs are formed in the containers to be symmetrical, the cut-out portions of the containers properly align with and receive the stacking tabs, regardless of which end wall is coplanar with the outward facing side wall of container 210. For example, if the container 710 were to be rotated 180 degrees such that the other end wall is coplanar with the outward facing side wall of container 210, stacking tabs 228A would be received by cut-out portion 782B, while adjacent tabs 228A and 328A would be received by 786B.

Continuing to form the second layer, a second container 810 is placed in end-to-end relation with respect to container 710. It will be appreciated that the dimensions of the containers are such that when placed end-to-end, the outward facing end wall of container 810 is coplanar with the outward facing side wall of container 410. When the container 810 is lowered into the position shown, the stacking tab 428B of container 410 extends upwardly into cut-out portion 882C of container 810, while adjacent stacking tabs 328B and 428A of containers 310 and 410, respectively, extend upwardly into cut-out portion 886C of container 810.

Next, three containers 910, 1010, and 1110 are placed in a side-by-side fashion in the remaining space of the second layer, beginning with container 910. The container 910 is placed on top of containers 510 and 210 in overlapping fashion such that one end wall of the container 910 abuts against the side wall of container 710, while the other end wall of container 910 is coplanar with the outer side wall of container 510. When the container 910 is lowered into the position shown, the stacking tab 228C of container 210 extends upwardly into cut-out portion 970A of container 910. Additionally, stacking tabs 528A and 528B of container 510 extend upwardly into cut-out portion 982B and 986B, respectively, and stacking tab 228D of containers 210 extends upwardly into cut-out portion 970B of container 910.

Once container 910 is in place, container 1010 is be lowered into the position shown such that one end wall of the container 1010 abuts against the side walls of containers 710 and 810, while the other end wall of container 1010 is coplanar with the outer side walls of containers 510 and 610. In this position, the stacking tabs 328C and 328D of container 310 extend upwardly into cut-out portion 1070A and 1070B of container 1010, respectively. Additionally, stacking tabs 528C and 528D of container 510 extend upwardly into cut-out portions 1082A and 1086B, respectively, and stacking tabs 628A and 628B of container 610 extend upwardly into cut-out portions 1082D and 1086D of container 1010, respectively.

At this point, the final container 1110 of the second layer may be lowered into place as shown. The container 1110 is placed on top of containers 610 and 410 in overlapping fashion such that one end wall of the container 1110 abuts against the side wall of container 810, while the other end wall of container 1110 is coplanar with the outer side wall of container 610. When the container 1110 is lowered into the position shown, the stacking tab 628C and stacking tab 628D of container 610 extends upwardly into cut-out portions 1182C and 1186C of container 1110, respectively. Additionally, stacking tabs 428C and 428D of container 410 extend upwardly into cut-out portion 1170A and 1170B, respectively. If a third layer is desired, the arrangement of the first layer is repeated on top of the second layer.

While the preferred embodiment of the invention has been illustrated and described, it will be appreciated that various changes can be made therein without departing from the spirit and scope of the invention. For example, the blank may also include other features specified by the customer, such as hand holds, vent holes and the like. Additionally, while the blank described above and illustrated herein depict the end wall 24 sandwiched between the end flaps 34A and 34B of the outer side walls 22 and the end flaps 50A and 50B of the inner side walls 40A and 40B, it will be readily evident to those skilled in the art that the containers blank may be slightly modified so as to allow the bottom end flaps 34A and 34B and 50A and 50B to be attached to either the inner or outer surface of the end walls 24. Further, it will be appreciated that the stacking tabs may be formed by double-ply end wall panels, which can be formed substantially identical as the side wall panels described above. In this embodiment, the location of the plurality of cut-outs that accept the end wall stacking tabs would change accordingly.

The embodiments of the invention in which an exclusive property or privilege is claimed are defined as follows:

1. A container blank, comprising:

a bottom wall panel;

an end wall panel hingedly connected to said bottom wall panel by a first fold line;

an outer side wall panel having an outer edge and hingedly connected to said bottom wall panel by a second fold line;

an inner side wall panel hingedly connected to said outer wall panel opposite said bottom wall panel by at least one bridge section;

a first cut-out portion positioned along said second fold line between said bottom panel and said outer side wall panel; and a second cut-out portion in said bottom wall panel spaced-apart from said first cut-out portion and positioned apart from said first fold line and said second fold line, wherein the width of said second cut-out portion is at least twice the thickness of the at least one bridge section.

2. The blank of claim 1, further comprising a third cut-out portion positioned along said first fold line between said bottom panel and said end wall.

3. The blank of claim 2, further including a fourth cut-out portion positioned along said second fold line, said fourth cut-out portion being spaced apart from said at least one first cut-out portion and said fourth cut-out portion being sized differently from said first cut-out portion.

4. The blank of claim 1, wherein the blank is formed from at least one of a cardboard, pasteboard, fiberboard, corrugated cardboard and plastic.

5. A container comprising:

a bottom wall, a pair of double side walls coupled with said bottom wall;

a stacking tab coupled with each of said pair of double side walls, said stacking tab positioned opposite said bottom wall;

end walls coupled with said bottom wall;

a first cut-out portion formed at the intersection of each of said side walls and said bottom wall; and, a second cut-out portion formed in said bottom panel spaced-apart from said first cut-out portion and positioned apart from said first fold line and said second fold line, wherein the second cut-out portion is sized to be at least twice the thickness of the stacking tab.

6. The container of claim 5, further comprising a third cut-out portion formed at the intersection of each of said end walls and said bottom wall.

7. The container of claim 6, further comprising a fourth cut-out portion formed at the intersection of each of said side walls and said bottom wall and spaced apart from said first cut-out portions, said fourth cut-out portion being sized differently from said first cut-out portion.

* * * * *